US006628238B2

(12) United States Patent
Ramanujam et al.

(10) Patent No.: US 6,628,238 B2
(45) Date of Patent: Sep. 30, 2003

(54) SUB-REFLECTOR FOR DUAL-REFLECTOR ANTENNA SYSTEM

(76) Inventors: Parthasarathy Ramanujam, 2601 Fisk La., Redondo Beach, CA (US) 90278; Albert E. Lyerly, 1700 Victoria Dr., Fullerton, CA (US) 92831-3024; Brian M. Park, 23518 Anza Ave. C, Torrance, CA (US) 90505; Hussain Haddad, 3909 S. Sepulveda Blvd. #409, Los Angeles, CA (US) 90049; Laurston C. Wah, 2601 404 S. Prospect, Manhatten Beach, CA (US) 90266

( * ) Notice: Subject to any disclaimer, the term of this patent is extended or adjusted under 35 U.S.C. 154(b) by 0 days.

(21) Appl. No.: 09/992,259

(22) Filed: Nov. 19, 2001

(65) Prior Publication Data

US 2003/0095075 A1 May 22, 2003

(51) Int. Cl.[7] ..... H01Q 19/19

(52) U.S. Cl. ..... 343/781 P; 343/761

(58) Field of Search ..... 343/781, 761, 343/839, 756, 781 P

(56) References Cited

U.S. PATENT DOCUMENTS 5,796,370 A * 8/1998 Courtonne et al. ..... 343/781
5,977,923 A * 11/1999 Contu et al. ..... 343/761

* cited by examiner

*Primary Examiner*—James Clinger

(57) ABSTRACT

An antenna includes a feed generating a communication signal. A sub-reflector is positioned to reflect the communication's signal to form a sub-reflective signal. A main reflector is positioned to reflect the sub-reflective signal. The sub-reflector has an elliptical rim.

19 Claims, 9 Drawing Sheets

SUB-REFLECTOR FOR DUAL-REFLECTOR ANTENNA SYSTEM

TECHNICAL FIELD

The present invention relates generally to an antenna system for a satellite, and more particularly, to a dual-reflector antenna system having an elliptical rim shape.

BACKGROUND OF THE INVENTION

Communication satellites use various types of antenna systems for communication. Phased array antennas are often used as well as antenna systems that use dual reflectors. Dual reflector antenna systems include a main reflector and a sub-reflector. A feed is used to radiate the communication signals to the sub-reflector which is then reflected to the main reflector. The main reflector then directs the communication signal to the desired communication target. The main reflector shapes the desired beam into a particular shape and direction in the far-field.

One problem with a dual reflector antenna system is that undesirable signals originating from the dual reflector antenna system may be present in the far field. Two types of undesirable signals present in the far field are signals that are radiated directly from the feed and signals that are scattered by the sub-reflector rim. Typically, the antenna geometry controls the amount that the feed contributes to the far field. However, signal scatter from the sub-reflector rim can coherently add in a particular direction to form a "gain effect." The signal scatter from the sub-reflector is caused by the rim edge. Although the reflected signal from the rim of the sub-reflector is smaller in intensity, it can interfere with the primary signal resulting in multi-path effects which can lead to ripple over the operating frequency band as well as ripple in the desired beam. In many communication systems it is required that a null signal or side lobe region be generated. These signals are usually of low signal strength. This is done for example, to prevent signal coverage in a particular direction of the far-field. The far-fields scatter from the sub-reflector can be significantly higher than the primary null signal or side lobe area signals.

One way in which to reduce undesirable signals originating from the feed and sub-reflector rim is to modify the antenna geometry. This may be accomplished by repositioning the feed and sub-reflector so that the coherent detracted field from the sub-reflector rim is pointed away from the direction of the desired be null. One draw back to this approach is that because of mechanical constraints of the spacecraft, arranging the sub-reflector and feed may not always be feasible.

It would therefore be desirable to improve the geometry of a sub-reflector system to reduce the amount of undesirable signal diffracted by the sub-reflector rim.

SUMMARY OF THE INVENTION

It is therefore one object of the invention to change the sub-reflector shape to reduce the amount of radiation reflecting from the rim thereof.

It one aspect of the invention an antenna system comprises a feed generating a communication signal. A sub-reflector is positioned to reflect the communication's signal to form a sub-reflective signal. A main reflector is positioned to reflect the sub-reflective signal. The reflector has an elliptical rim.

In a further aspect of the invention, the sub-reflector has a super-elliptical rim shape.

One advantage of the present invention is that the elliptical rim shape may be used for various reflector configurations such as a Cassegranian or Gregorian. Another advantage of the invention is that increased null depth and side lobe characteristics are obtained. In one construction configuration, a null depth was increased by a factor of sixteen.

These and other advantages, features and objects of the invention will become apparent from the drawings, detailed description and claims which follow.

DETAILED DESCRIPTION OF THE PREFERRED EMBODIMENT(S)

Figure 1:
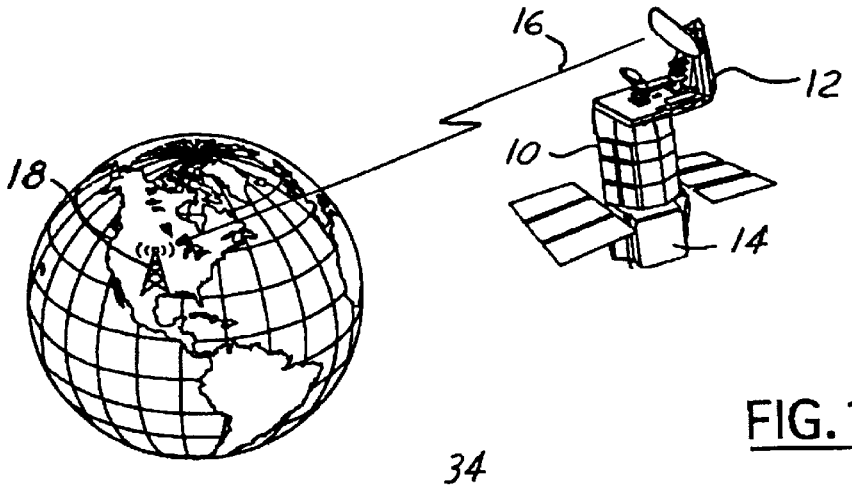
FIG. 1 is a prospective view of a satellite having an antenna system according to the present invention positioned above the earth.

In the following figures, the same reference numeral will be used to identify the same components in the various views.

Referring now to the FIG. 1, a satellite 10 is illustrated having an antenna system 12 configured according to the present invention. Antenna system 12 is coupled to a beam forming network and generates and generates signals therefrom. Antenna system 12 is used to generate a communication 16 to a ground station 18. Ground station 18 receives the communication signal 16. Ground station 18 may be mobile or fixed and may also generate uplink signals to satellite 10.

Figure 2:
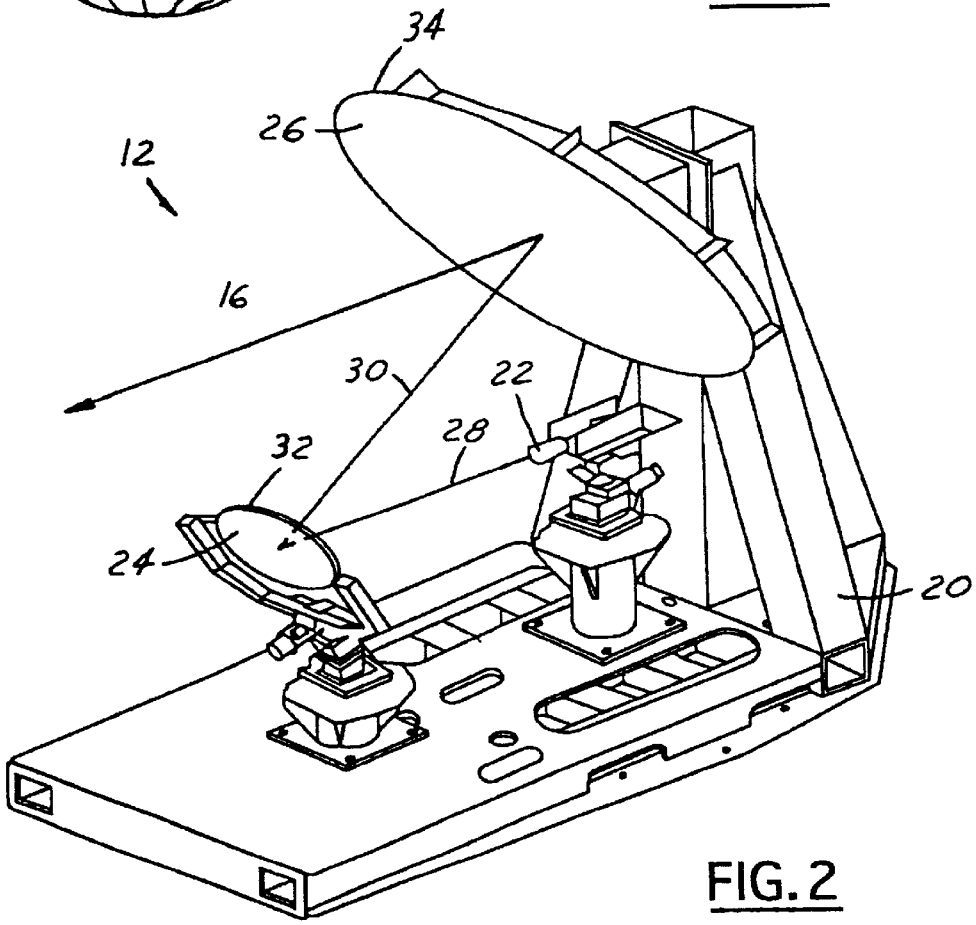
FIG. 2 is a prospective view of the antenna system of FIG. 1 in a Cassegranian configuration.

Referring now to FIG. 2, antenna system 12 is illustrated in further detail. Antenna system 12 is coupled to a housing 20. Housing 20 may be a portion of the spacecraft body or a separate housing fixedly coupled to the body of the spacecraft. Preferably, housing 20 is deployable after launch of the satellite 10. Housing 20 is used to position a feed 22, a sub-reflector 24, and a main reflector 26. As illustrated feed 22, sub-reflector 24, and main reflector 26 are configured in a Cassegranian dual reflector geometry. In this constructed embodiment, feed 22 comprises seven individual feeds that generate a feed signal 28 that is directed sub-reflector 24. Sub-reflector 24 reflects a sub-reflective signal 30, which in turn reflects from main reflector 26 to form communication signals 16.

As will be further described below, sub-reflector 24 has a rim 32 that is preferably shaped as an ellipse and more preferably shaped as a super-ellipse. The surface of sub-reflector 24 is preferably shaped as a hyperboloid.

Main reflector 26 preferably has a circular rim 34 having a surface with the shape of a paraboloid.

Figure 3:
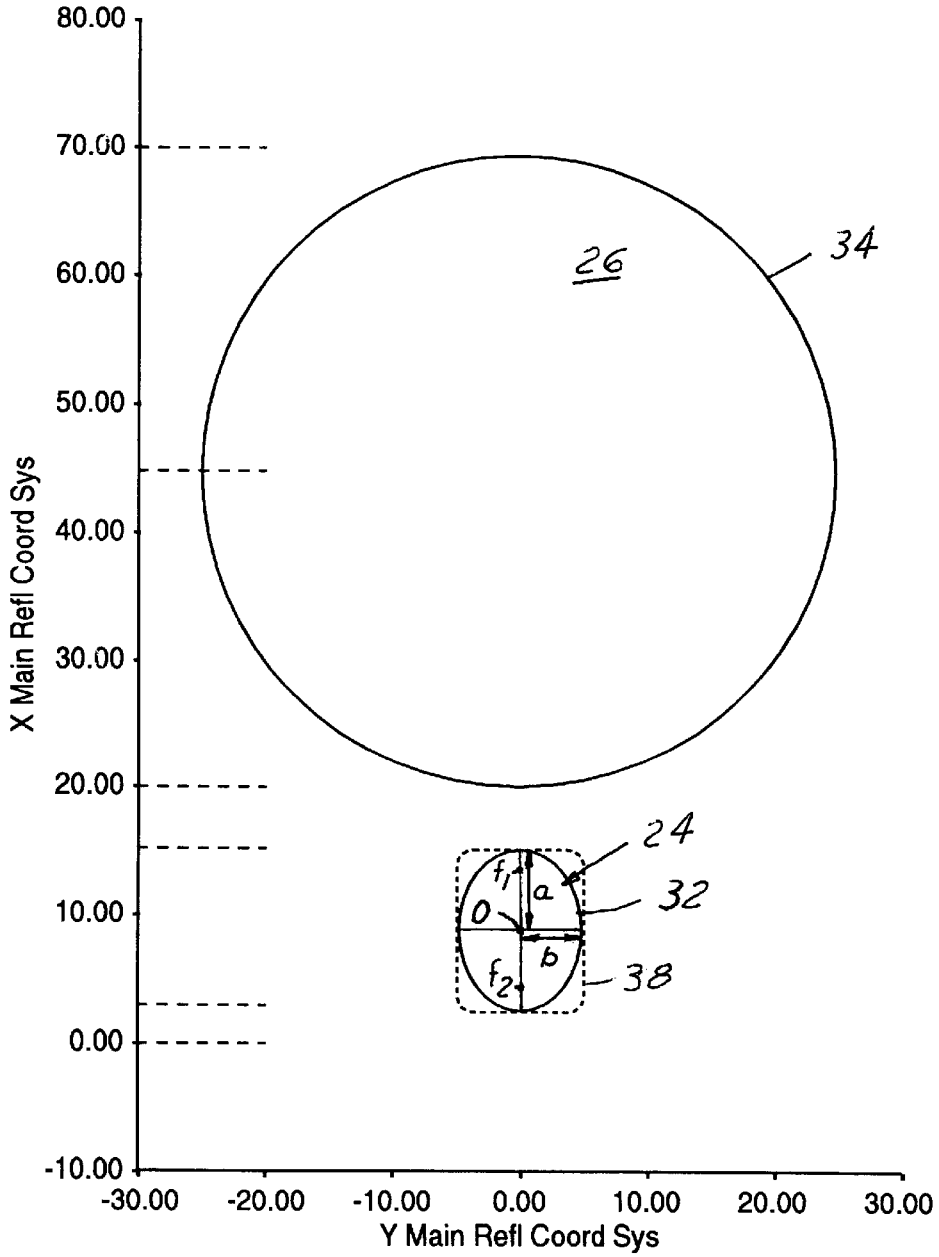
FIG. 3 is a projected aperture view of the present invention.

Referring now to FIG. 3, an aperture view of an antenna is illustrated. The view has dashed lines at the x-axis to illustrate where key features project. As can be seen in this view, the relative positions of sub-reflector 24 and main reflector 26 are shown. As mentioned above, sub-reflector 24 has rim 32 which is preferably a super-ellipse of the form: $(x/a)^m+(y/b)^n=1$ where a is half the major axis and b is half the minor axis portion. The Origin O is the center. The ellipse also has two focal points $f_1$ and $f_2$. Preferably, at least one of the powers m or n are greater than 2 in contrast to a conventional ellipse. By increasing the powers of m and n greater than 8 the ellipsoid expands to area 38 defined by dash lines. Advantageously, by providing a super ellipsoid, the present invention reduces the far field radiation in the null area of the reflective signal.

Figure 4:
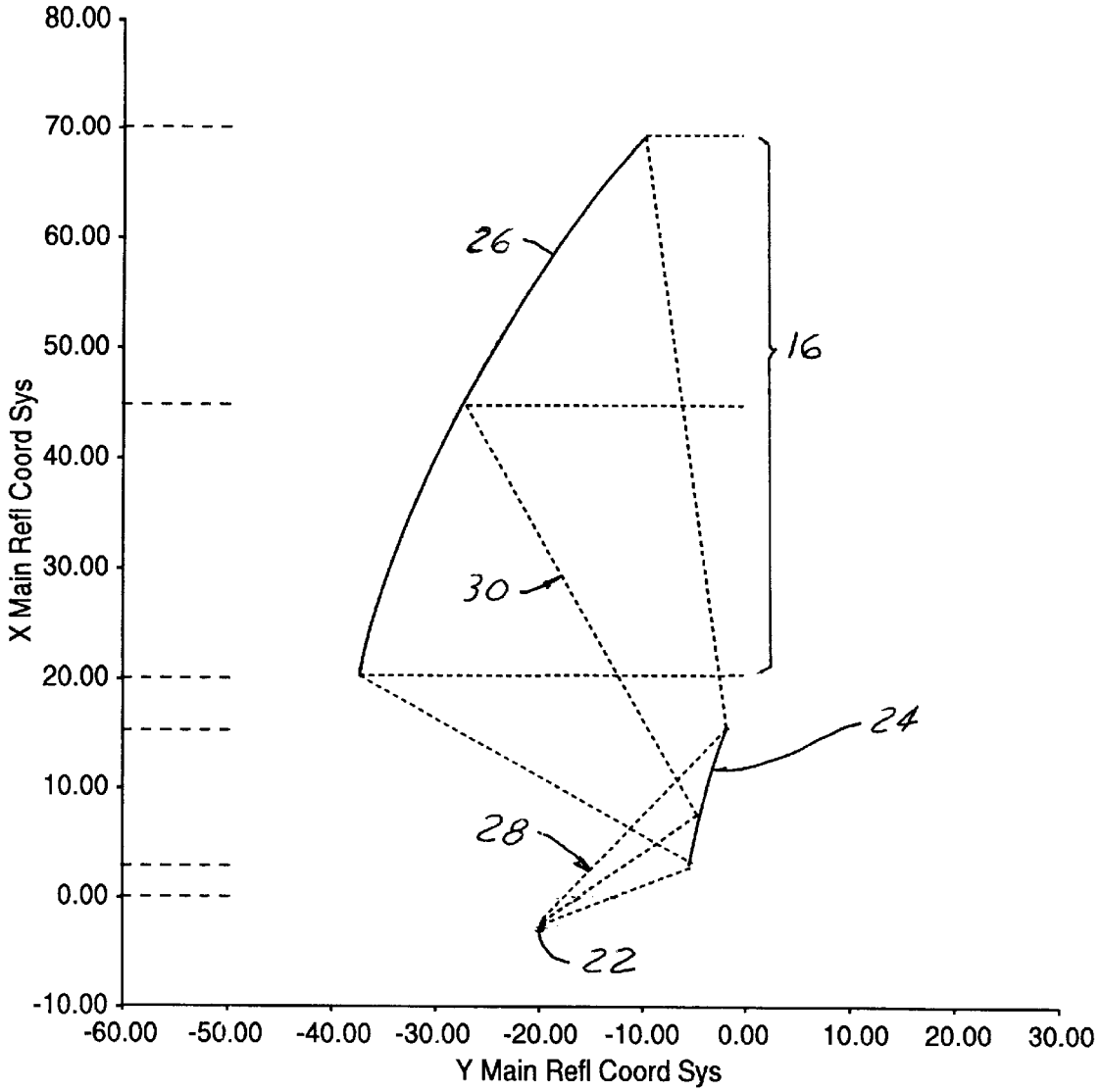
FIG. 4 is a side view of the antenna configuration of FIG. 3.

Referring now to FIG. 4, a side view illustrating the geometry of the present invention is illustrated. As shown, feed 22 generates feed signal 28, which reflects from sub-reflector 24. Sub-reflector 24 reflects the sub-reflector signal 30 to main reflector 26. Main reflector 26 reflects sub-reflector signal 30 to form communication signal 16.

Figure 5:
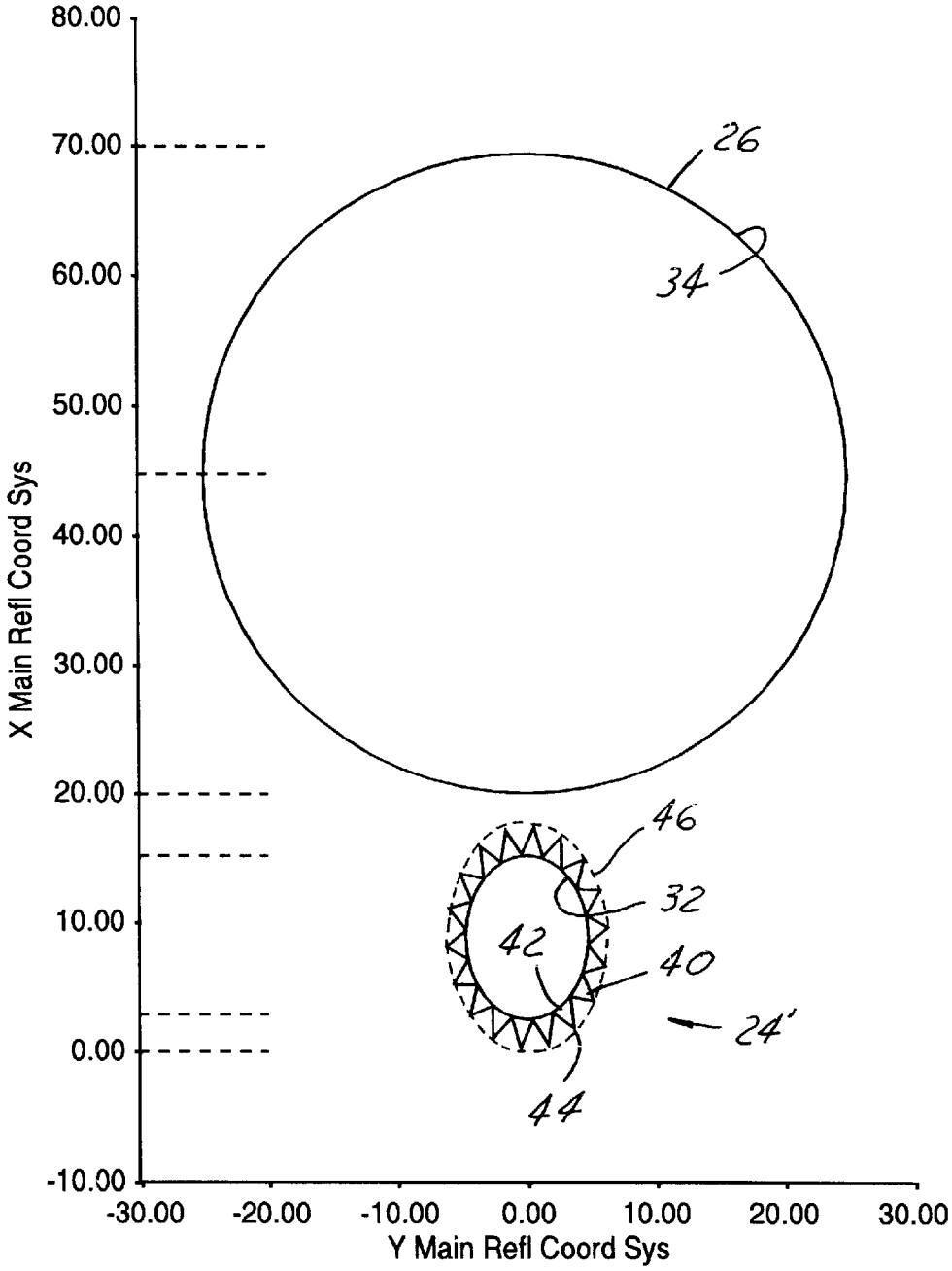
FIG. 5 is an alternative aperture view of a Cassegranian antenna having a sub-reflector with saw-tooth portions.

Referring now to FIG. 5, an alternative configuration to that shown in FIG. 3 is illustrated. In this embodiment, sub-reflector 24' has a similar shape to that of FIG. 3 except for the additional of saw-tooth-shaped 40. Saw-tooth-shaped portion 40 are substantially triangular-shaped extension having a base 42 the shape of rim 32, that is of ellipse. Saw-tooth portion 40 has a vertex 44 position opposite base 42. When each of the vertices 44 is connected together, an ellipse or super-ellipse shape 46 is formed. That corresponds to the shape rim 46 of sub-reflector 24'.

Figure 6:
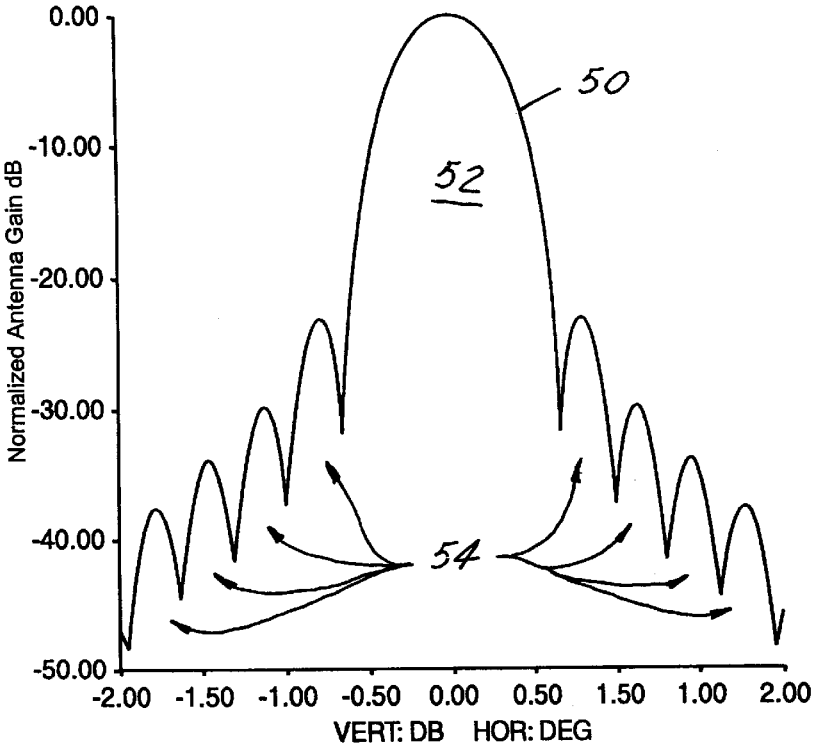
FIG. 6 is a plot of a signal admitted by the antenna system in a communication mode.

Referring now to FIG. 6, a cross-sectional gain plot of communication signal 16 is illustrated as reference numeral 50. Communication mode 50 has a main lobe 52 and a plurality of side lobes 54. As can be seen, main lobe 52 is well defined and has a higher gain then that of side lobes 54.

Figure 7:
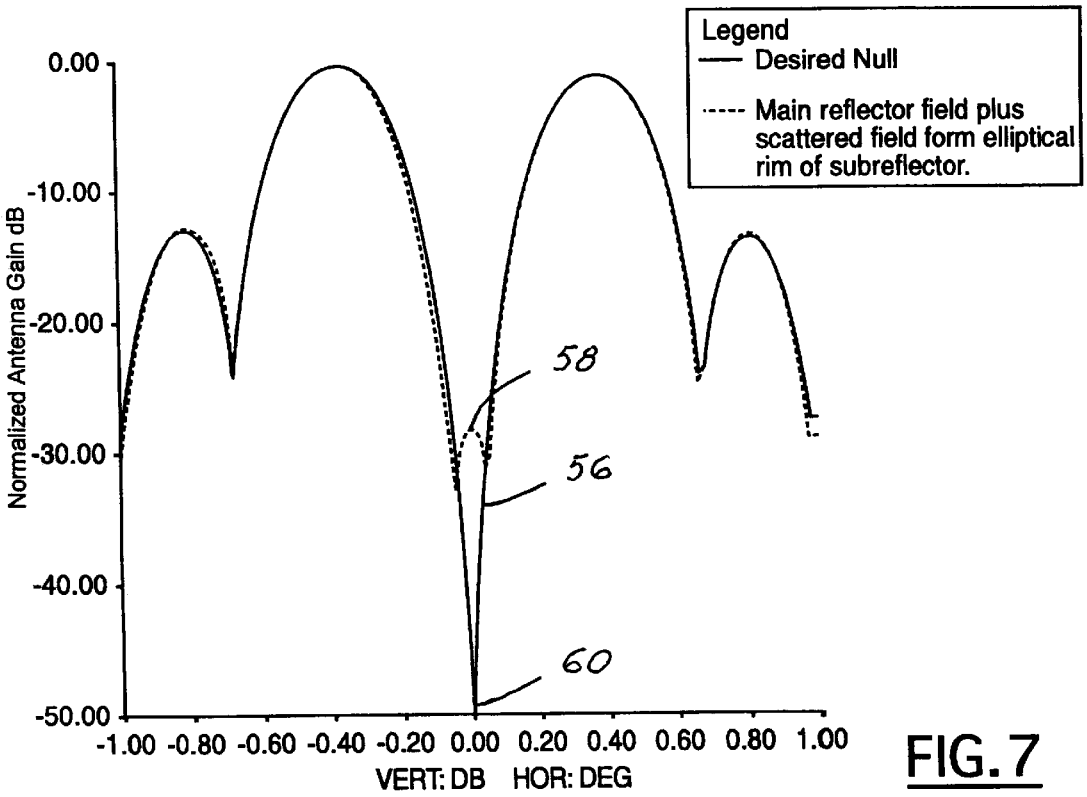
FIG. 7 is a comparison plot of a communication signal having a null using a prior art configuration and the present invention.

Referring now to FIG. 7, a null mode signal 56 formed using an improved rim shape according to the present invention is illustrated in contrast to a null mode signal 58 using an antenna configuration in the prior art. As can be seen the null point 60 of null mode signal 56 has a substantial increase in null depth performance from that of prior art. That is, because the rim of the prior art scatters the communication signal at a high intensity to cause null filling in the direction of the null mode signal. In contrast, the present invention null performance has a much deeper null. That is, because of the sub-reflector rim of the present invention has substantially reduced diffracted signal that adds very little null filling signal.

As illustrated, null filing due to the scattered fields in the sub-reflector were approximately 26 decibels versus the about 50 decibels of the present invention results in an improvement of about 16 times.

Figure 8:
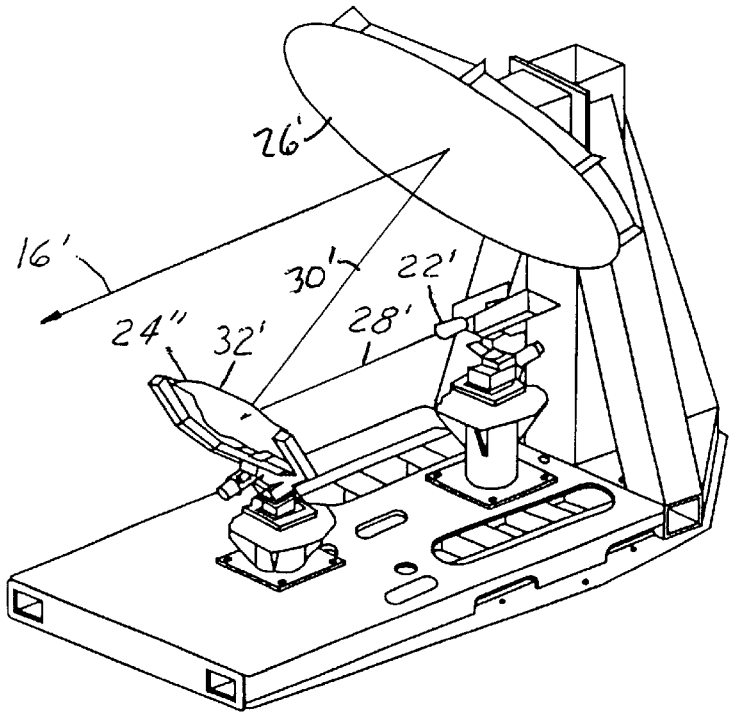
FIG. 8 is a prospective view of alternative embodiment of the present invention in a Gregorian configuration.

Referring now to FIG. 8, a Gregorian reflector geometry is illustrated. The configuration is similar in that a feed 22' is used to generate a feed signal 28' to sub-reflector 24". Sub-reflector 24" generates a sub-reflected signal 30' to main reflector 26' which in turn is reflected from main reflector 26' as communication signal 16'. In the Gregorian configuration, sub-reflector 24" has a rim 32' shaped in a similar manner to that described above. The shape of the sub-reflector surface however, is a paraboloid.

Figure 9:
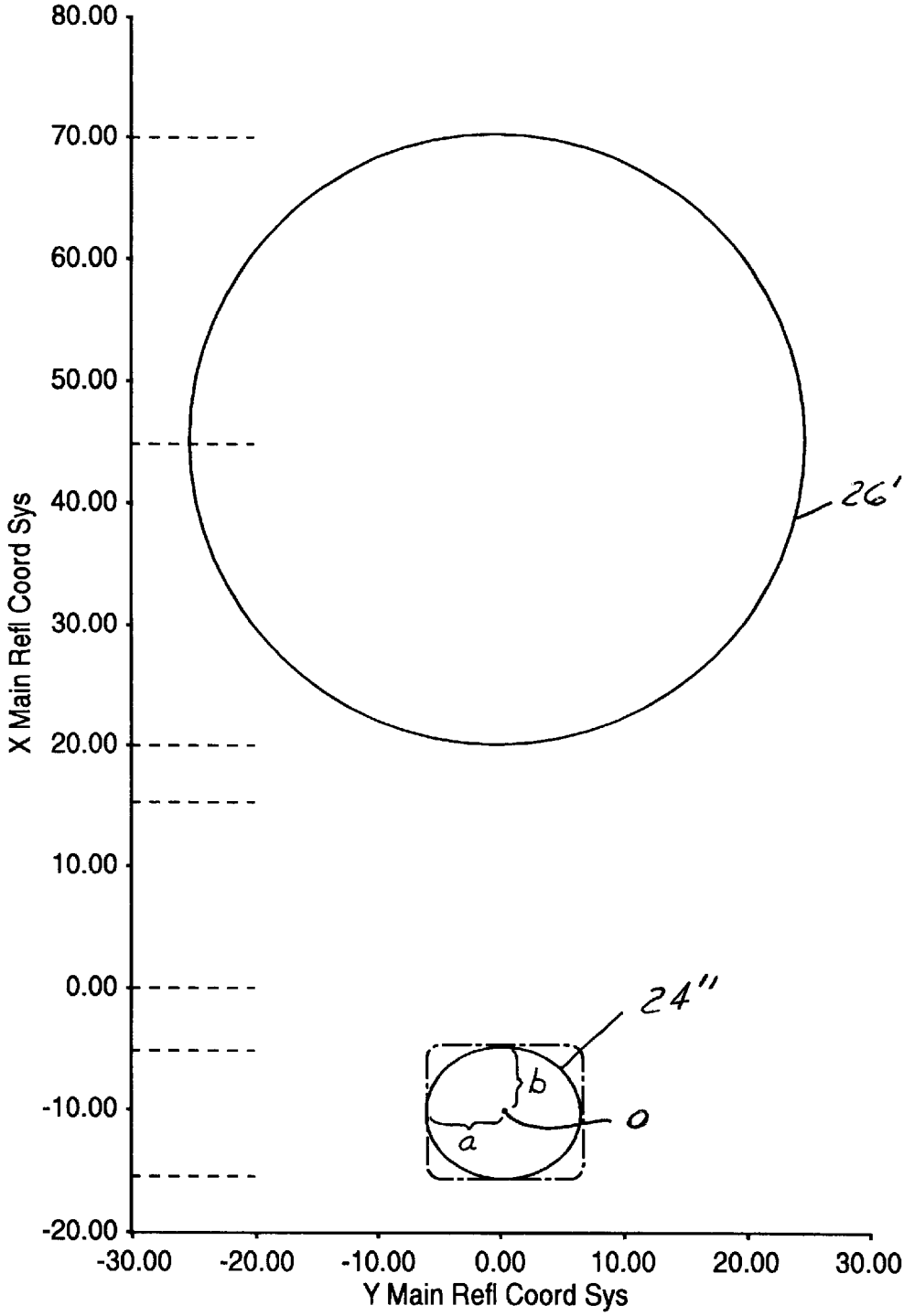
FIG. 9 is a projected aperture view of the antenna configuration of FIG. 8.
Figure 10:
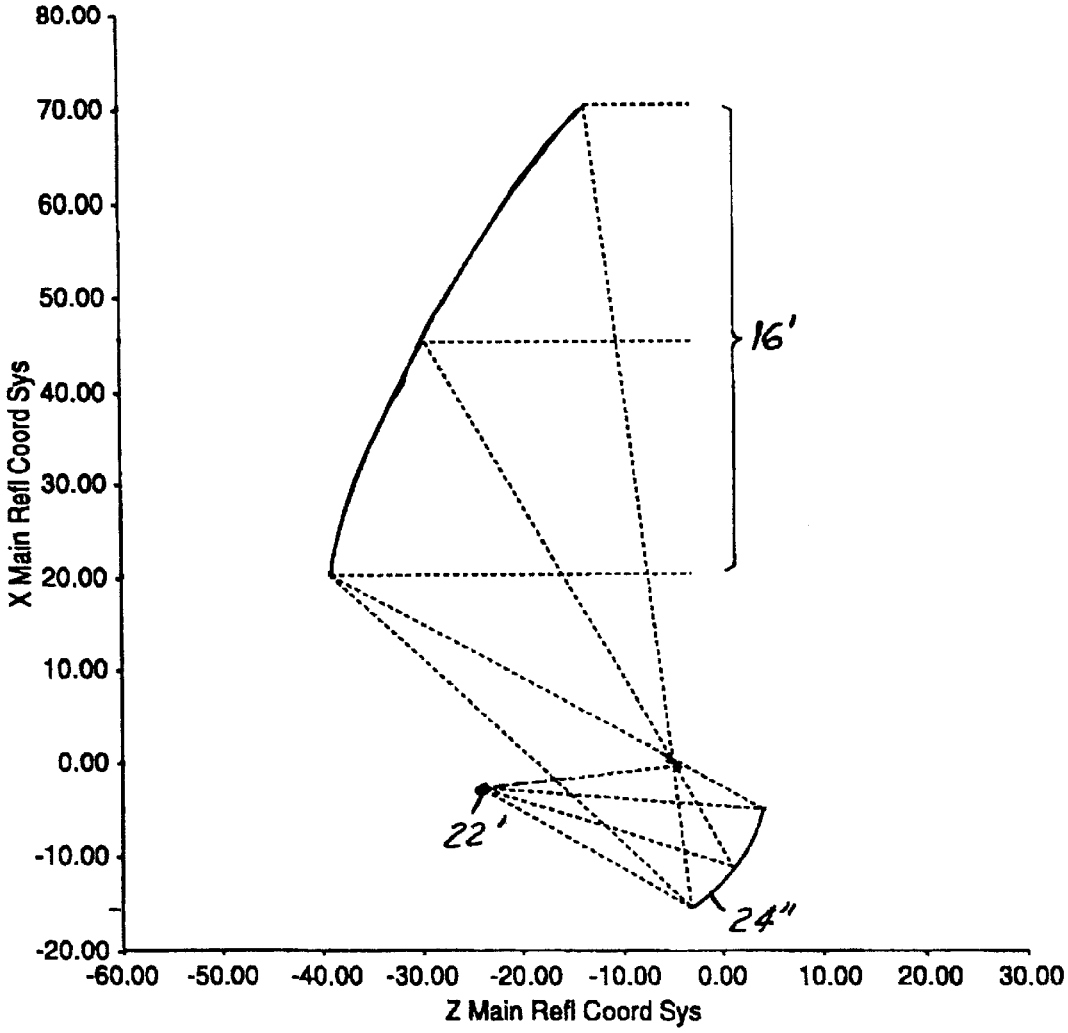
FIG. 10 is a side view of the antenna of FIG. 9.

Referring now to FIGS. 9 and 10, a respective projection view and side view of the Gregorian configuration is illustrated. As can be seen, the relative position of main reflector 26' and sub-reflector 24" are slightly different, but the result is a similar communication signal 16' to that described above.

Figure 11:
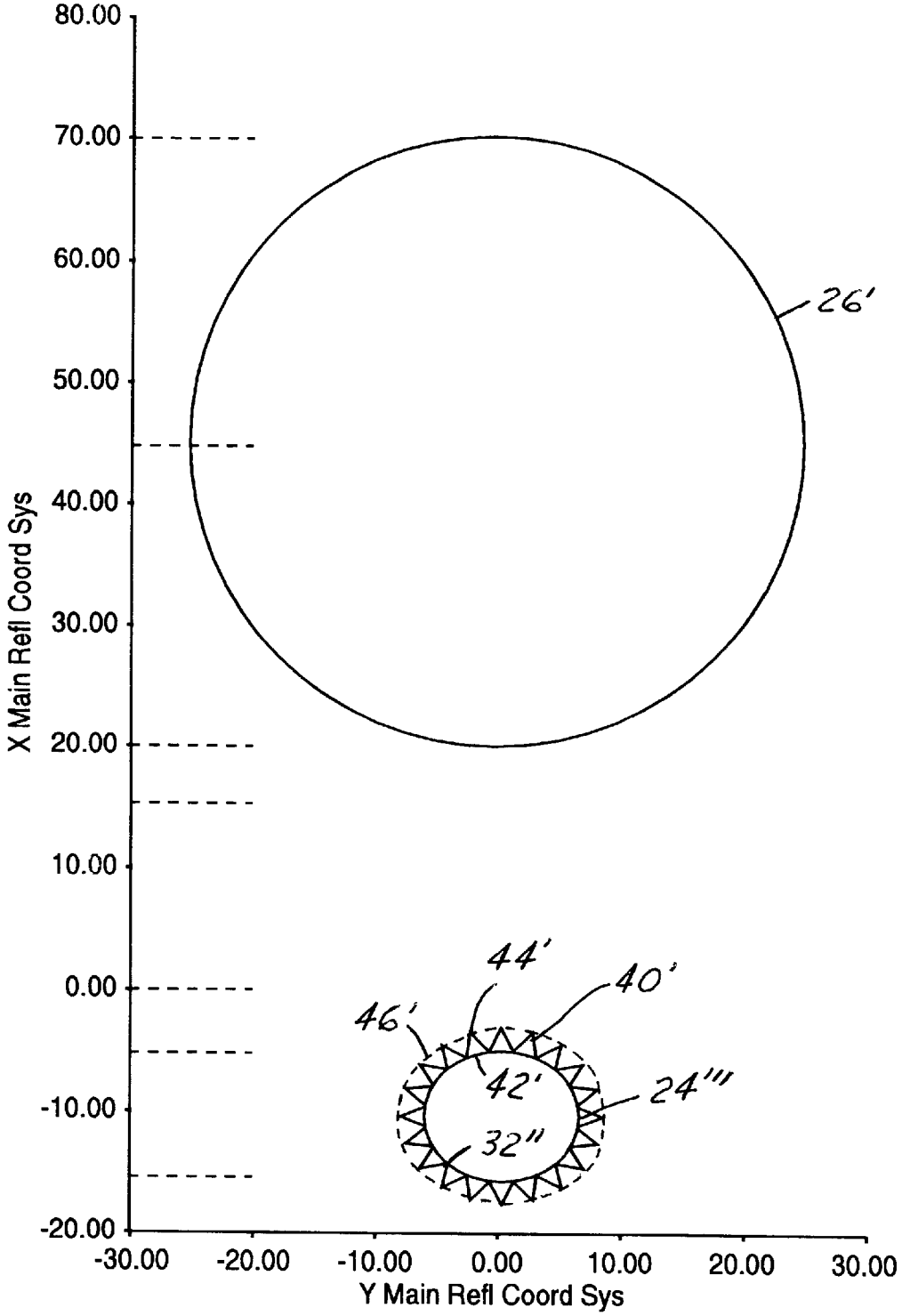
FIG. 11 is an alternative projected aperture view of the antenna Gregorian antenna configuration of FIGS. 8, 9, and 10 having saw-tooth portions thereon.

Referring now to FIG. 11, a sub-reflector 24'" has saw-tooth portions 40' similar to that described above. Saw-tooth portions 40' have base 42' coextensive with rim 32" of sub-reflector 24'". Saw-tooth portions 40' have vertex 44' which extends a distance from rim 32". Shape 46' is preferably parallel to rim 32" of sub-reflector 24'".

Advantageously, both the Gregorian and Cassegranian configuration reduce the null filing due to the sub-reflected scattered field without having to substantially change the antenna shape or general configuration of the antenna.

While particular embodiments of the invention have been shown and described, numerous variations and alternate embodiments will occur to those skilled in the art. Accordingly, it is intended that the invention be limited only in terms of the appended claims.

What is claimed is:

1. An antenna system comprising:

a feed generating a feed signal;

a sub-reflector positioned to reflect said communication signal to form a sub-reflected signal;

a main reflector positioned to reflect said sub-reflected signal; and said sub-reflector having a super-elliptical rim.

2. An antenna system as recited in claim 1 wherein said super-elliptical rim is formed according to the equation: $(x/a)^m+(y/b)^n=1$, where a is the major axis, b is the minor axis.

3. An antenna system as recited in claim 2 wherein m is greater than 2.

4. An antenna system as recited in claim 2 wherein n is greater than 2.

5. An antenna system as recited in claim 2 wherein m and n are 8 or more.

6. An antenna system as recited in claim 2 wherein a is substantially equal to b.

7. An antenna system as recited in claim 1 wherein said sub-reflector comprises a hyperboloid.

8. An antenna system as recited in claim 1 wherein said sub-reflector comprises a paraboloid.

9. An antenna system as recited in claim 1 wherein said main reflector comprises a paraboloid.

10. An antenna system as recited in claim 1 wherein said main reflector comprises an elliptical rim.

11. An antenna system as recited in claim 1 wherein said main reflector and said sub-reflector are disposed in a Cassegranian geometry.

12. An antenna system as recited in claim 1 wherein said main reflector and said sub-reflector are disposed In a Gregorian geometry.

13. An antenna system comprising:

a feed generating a feed signal;

a sub-reflector positioned to reflect said communication signal to form a sub-reflected signal;

a main reflector positioned to reflect said sub-reflected signal; and said sub-reflector having a super-elliptical rim formed according to the equation: $(x/a)^m=(y/b)^n=1$.

14. An antenna system comprising:

a feed generating a feed signal;

a sub-reflector positioned to reflect said communication signal to form a sub-reflected signal;

a main reflector positioned to reflect said sub-reflected signal; and said sub-reflector having an elliptical rim, said elliptical rim having a plurality of sawtooth protrusions extending therefrom.

15. An antenna system as recited in claim 14 wherein said sawtooth protrusions have a tip extending therefrom a predetermined distance so that said tips outline an ellipse.

16. A satellite comprising:

a body;

an antenna system coupled to the body, said antenna system comprising;

a feed generating a teed signal;

a sub-reflector positioned to retreat said communication signal to form a sub-reflected signal;

a main reflector positioned to reflect said sub-reflected signal; and said sub-reflector having a super-elliptical rim.

17. An satellite system as recited in claim 16 wherein said super-elliptical rim formed according to the equation: $(x/a)^m+(y/b)^n=1$, where a is the major axis, b is the minor axis.

18. An satellite system as recited in claim 16 wherein m is greater than 2.

19. An satellite system as recited in claim 16 wherein n is greater than 2.

* * * * *

UNITED STATES PATENT AND TRADEMARK OFFICE

CERTIFICATE OF CORRECTION

PATENT NO. : 6,628,238 B2
DATED : September 30, 2003
INVENTOR(S) : Parthasarathy Ramanujam et al.

It is certified that error appears in the above-identified patent and that said Letters Patent is hereby corrected as shown below:

Column 6,
Line 1, should read as follows: -- a feed generating a feed signal. --
Line 2, should read as follows: -- a sub-reflector positioned to reflect said communication --

Signed and Sealed this

Third Day of February, 2004

JON W. DUDAS
*Acting Director of the United States Patent and Trademark Office*